US008511665B2

(12) United States Patent
Iwata et al.

(10) Patent No.: US 8,511,665 B2
(45) Date of Patent: Aug. 20, 2013

(54) SHEET PROCESSING APPARATUS AND IMAGE FORMING APPARATUS

(75) Inventors: Toshiyuki Iwata, Toride (JP); Yusuke Obuchi, Nagareyama (JP); Hideki Kushida, Moriya (JP); Rikiya Takemasa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 13/102,245

(22) Filed: May 6, 2011

(65) Prior Publication Data

US 2011/0286828 A1 Nov. 24, 2011

(30) Foreign Application Priority Data

May 18, 2010 (JP) ..... 2010-113844
Apr. 27, 2011 (JP) ..... 2011-099697

(51) Int. Cl.
*B65H 33/04* (2006.01)

(52) U.S. Cl.
USPC ..... 270/58.31; 270/58.01; 270/58.32; 271/285; 271/286

(58) Field of Classification Search
USPC ..... 270/58.08, 58.09, 58.1, 58.11, 58.31, 270/58.32, 58.01; 271/184, 285, 286
See application file for complete search history.

(56) References Cited

U.S. PATENT DOCUMENTS

| | | | | |
|---|---|---|---|---|
| 5,112,034 | A * | 5/1992 | Uto et al. | 270/58.12 |
| 5,765,824 | A * | 6/1998 | Kawano et al. | 270/58.11 |
| 6,209,864 | B1 * | 4/2001 | Taniguchi et al. | 271/220 |
| 6,241,234 | B1 * | 6/2001 | Saitoh et al. | 270/58.12 |
| 6,315,288 | B1 * | 11/2001 | Sugishima et al. | 271/303 |
| 7,543,806 | B2 * | 6/2009 | Nakamura et al. | 270/58.11 |
| 7,584,948 | B2 * | 9/2009 | Fujii et al. | 270/58.11 |
| 7,780,159 | B2 * | 8/2010 | Nishimura et al. | 270/58.11 |
| 8,038,138 | B2 * | 10/2011 | Iguchi | 270/58.11 |
| 8,104,758 | B2 * | 1/2012 | Tanaka et al. | 270/58.11 |
| 8,292,285 | B2 * | 10/2012 | Yokoya et al. | 270/58.31 |
| 2003/0006548 | A1 | 1/2003 | Murata | |
| 2008/0151285 | A1 | 6/2008 | Morales | |

FOREIGN PATENT DOCUMENTS

| | | | |
|---|---|---|---|
| EP | 1762526 | A2 | 3/2007 |
| JP | 10-194582 | A | 7/1998 |
| JP | 10-279166 | A | 10/1998 |

* cited by examiner

*Primary Examiner* — Patrick Mackey
(74) *Attorney, Agent, or Firm* — Canon USA, Inc., IP Division

(57) ABSTRACT

A sheet processing apparatus includes a processing tray configured to stack a sheet to be processed, a sheet overlap unit configured to allow a sheet fed while the sheet to be processed is stacked on the processing tray, to be overlaid and made to wait, first and second bundle conveyance rollers configured to convey the sheet to the processing tray from the sheet overlap unit, and a sheet processing apparatus control unit configured to control an overlap operation in the sheet overlap unit, wherein the sheet processing apparatus control unit determines, based on sheet information relating to the sheet fed to the sheet overlap unit, whether a sheet to be then fed is overlaid on the sheet fed to the sheet overlap unit.

9 Claims, 11 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and more particularly, to a sheet processing apparatus and an image forming apparatus improving, when a tab sheet having a tab serving as a projection is overlaid on a sheet in a sheet conveyance path to form a sheet bundle to be conveyed and output, an alignment grade of the output sheets including the tab sheet.

2. Description of the Related Art

Conventionally, a sheet processing apparatus that performs various types of processing for a sheet discharged from a main body of an electrophotographic image forming apparatus for forming an image using toner has been mounted as an option. Such sheet processing apparatuses have been contrived to avoid deterioration in productivity occurring when sheet processing, which requires a relatively long processing time, for example, processing for binding sheets into a sheet bundle is performed.

For example, a sheet conveyed from the image forming apparatus main body while a preceding sheet bundle is processed in a processing tray is made to temporarily wait in a conveyance path in the sheet processing apparatus.

A sheet is repeatedly stopped and conveyed with precise timing to overlap a predetermined number of sheets corresponding to a sheet processing time of the preceding sheet bundle to form a sheet bundle in the conveyance path, and the first several sheets included in the subsequent sheet bundle are made to wait, to ensure the sheet processing time of the preceding sheet bundle. After the preceding sheet bundle is discharged from the processing tray, the sheets that are waiting are conveyed onto the processing tray, and are aligned in the sheet conveyance direction by their edges in the sheet conveyance direction abutting on a stopper.

The sheet processing apparatus includes a transporting member that abuts, when the overlapped sheets are conveyed onto the processing tray, on only the uppermost sheet so as to cause edges of the sheets, in the sheet conveyance direction, conveyed onto the processing tray to collide against the stopper.

The lower sheets, on which the transporting member does not abut, collides against the stopper using a frictional force between the sheets generated when the uppermost sheet is transported. At this time, when the uppermost sheet abuts on the stopper earlier than the lower sheets, the lower sheets may be stopped before abutting on the stopper, resulting in alignment failure.

In order to prevent this, when the sheets are overlapped, the sheets can be conveyed onto the processing tray after their edges in the sheet conveyance direction are lined up and while the state is maintained so that the overlapped sheets simultaneously abut on the stopper. When a plurality of sheets is overlapped in the conveyance path, however, their edges in the sheet conveyance direction are difficult to line up due to errors in the length of sheets in the conveyance direction and conveyance errors occurring when conveyance means is driven.

Therefore, sheets are overlapped by previously shifting the lower sheet toward a stopper by a predetermined amount from the upper sheet so that the lower sheet abuts on the stopper earlier than the upper sheet even when the above-mentioned error occurs as discussed in Japanese Patent Application Laid-Open No. 10-194582.

When the sheets abut on the stopper using a frictional force between the sheets, as described above, however, alignment failure may occur depending on the type of sheet to be overlapped, such as a tab sheet, coated paper, or a Z-folded sheet. When a standard sheet is overlaid on a tab sheet having a tab (an index portion, a heading, an index) that projects in the sheet conveyance direction at a position, which differs depending on the individual tab sheet, in a width direction perpendicular to the sheet conveyance direction, for example, alignment failure may occur on the processing tray.

Generally, a tab sheet having a tab serving as an index portion of a sheet bundle including a plurality of sheets is made of thick paper having a larger thickness than that of a normal sheet having no tab, and thus has a greater weight than that of the normal sheet.

When the tab sheet is placed as the second sheet of three sheets, for example, the tab sheet may be unable to transport because the weight thereof is large even if it attempts to abut on the stopper by a transporting force generated by friction with the uppermost sheet. When the tab sheet is the lowermost sheet, a similar phenomenon may also occur.

When coated paper, the surface of which has been subjected to surface processing or coating processing to obtain a surface property suitable for a color image; or a Z-folded sheet obtained by folding a large-format sheet in a Z shape is overlapped on a position other than the uppermost sheet, a similar phenomenon may also occur.

The surface of the coated paper is smoothed by pressure-welding the surface using a metal roller or the like, or applying a special chemical to the surface. When the surface of the coated paper is pressure-welded, the density of the coated paper becomes higher than that of a normal sheet having the same thickness, so that the coated paper has a greater weight than that of the normal sheet. Since the surface of the coated paper is smooth, a frictional force generated between the sheets is small.

A Z-folded sheet can be obtained by folding an A3 size sheet in a Z shape to have an A4 size, for example. The Z-folded sheet, together with a normal sheet of an A4 size, can be bookbound. If the size of the Z-folded sheet after the folding is the same as that of the normal sheet, then the weight of the Z-folded sheet will be larger than that of the normal sheet. Only an edge of the z-folded sheet, which contacts the upper sheet, may be transferred by a frictional force from the upper sheet, and an edge of the z-folded sheet, which does not contact the upper sheet, may remain un-moved.

SUMMARY OF THE INVENTION

The present invention is directed to a sheet processing apparatus and an image forming apparatus capable of satisfactorily aligning sheets, which have been overlapped and made to wait, on a processing tray, based on sheet information indicating whether a frictional force between the sheets is effectively exerted on the lower sheets.

According to an aspect of the present invention, a sheet processing apparatus includes a sheet stacking unit configured to stack sheets to be processed, a sheet overlap unit configured to allow a predetermined number N of successively fed sheets to be overlapped and made to wait, while preceding sheets to be processed are being stacked on the sheet stacking unit, a conveyance unit configured to convey overlapped sheets from the sheet overlap unit to the sheet stacking unit, and a control unit configured to control the overlapping of sheets in the sheet overlap unit, wherein the control unit is arranged to determine, based on sheet information relating to an Mth sheet fed to the sheet overlap unit, before the number of fed sheets reaches the predetermined number N, whether an M+1th sheet is overlapped on the Mth sheet in the sheet overlap unit.

According to the present invention, it is determined whether the sheet to be fed next in a series of sheets is overlapped on an earlier sheet fed to the sheet overlap portion based on the sheet information relating to the sheet fed to the sheet overlap portion. Therefore, when the sheets are overlapped, output and aligned, the degree of alignment of the output sheets is improved.

Further features and aspects of the present invention will become apparent from the following detailed description of embodiments with reference to the attached drawings.

BRIEF DESCRIPTION OF THE DRAWINGS

The accompanying drawings, which are incorporated in and constitute a part of the specification, illustrate embodiments, features, and aspects of the invention and, together with the description, serve to explain the principles of the invention.

DESCRIPTION OF THE EMBODIMENTS

Various embodiments, features, and aspects of the invention will be described in detail below with reference to the drawings.

A sheet processing apparatus according to an embodiment of the present invention, and an image forming apparatus including the sheet processing apparatus will be described below with reference to FIGS. 1 to 11.

Figure 1:
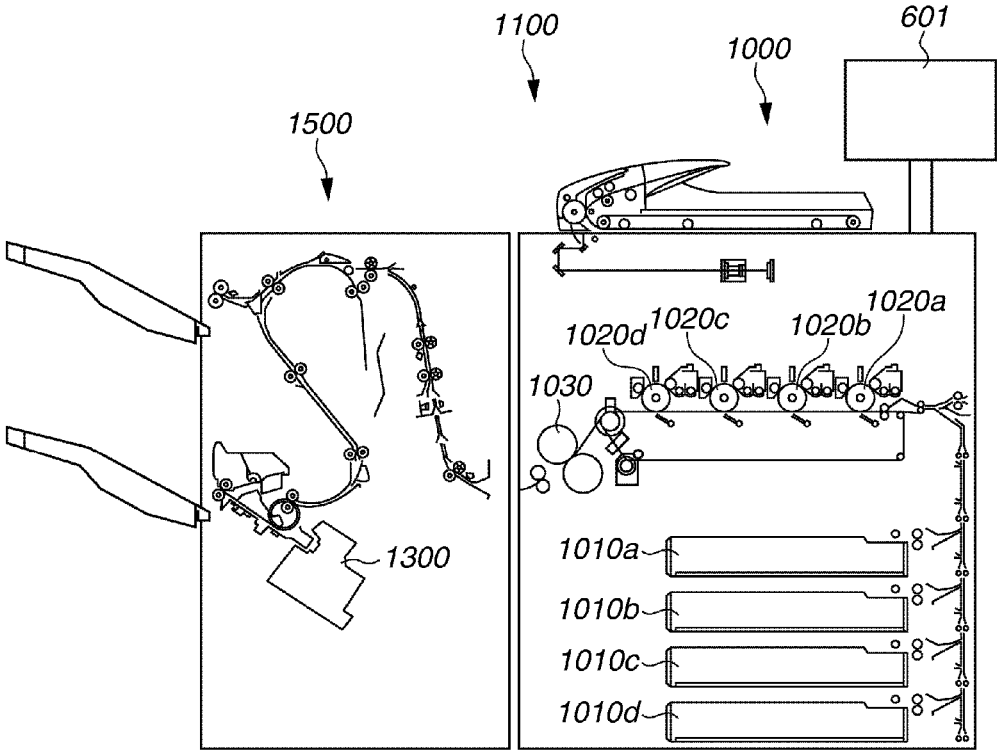
FIG. 1 is a cross-sectional view of an image forming apparatus according to an embodiment of the present invention.

FIG. 1 illustrates an image forming apparatus 1100 according to an embodiment of the present invention. The image forming apparatus 1100 includes an image forming apparatus main body 1000 serving as an electrophotographic copying machine, and a sheet processing apparatus 1500.

Figure 2:
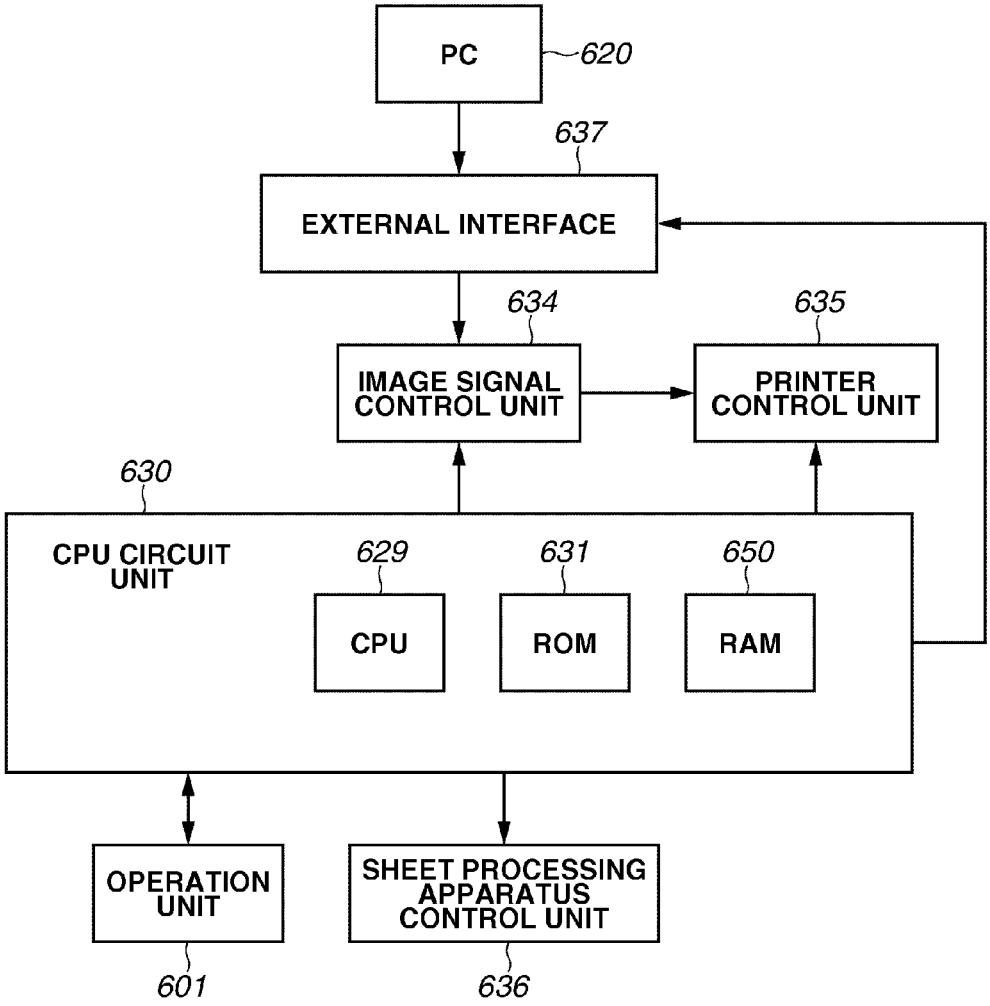
FIG. 2 is a block diagram of the image forming apparatus.

The sheet processing apparatus 1500 is connected to the image forming apparatus main body 1000, and includes a stapler 1300 for side stitching serving as sheet processing means as illustrated in FIG. 2. A sheet discharged from the image forming apparatus main body 1000 is directly accepted in the sheet processing apparatus 1500, and can be processed so-called online.

In the present embodiment, the sheet processing apparatus 1500 is set as a detachable option, and is usable by the image forming apparatus main body 1000 alone. However, the sheet processing apparatus 1500 may be incorporated into the image forming apparatus main body 1000 as standard equipment.

A sheet fed from each of cassettes 1010*a* to 1010*d* serving as feeding means in the image forming apparatus main body 1000 is fed to yellow, magenta, cyan, and black photosensitive drums 1020*a* to 1020*d* serving as image forming means.

A tab sheet having a tab serving as a projection that projects from its sheet edge by a predetermined width is accommodated in addition to a normal cut sheet in each of the cassettes 1010*a* to 1010*d*, and is fed according to the intended use. After toner images in four colors, which have been developed by color developing units, are transferred onto a sheet, the sheet on which the toner images have been transferred is conveyed to a fixing device 1030. The sheet is discharged out of the image forming apparatus main body 1000 after the toner images on the sheet are fixed by heat and pressure.

FIG. 2 is a block diagram illustrating an apparatus control unit for controlling the image forming apparatus 1100. As illustrated in FIG. 2, a central processing unit (CPU) circuit unit 630 includes a CPU 629, a read-only memory (ROM) 631, and a random access memory (RAM) 650.

The CPU circuit unit 630 controls an image signal control unit 634, a printer control unit 635, a sheet processing apparatus control unit 636, and an external interface 637 according to a program stored in the ROM 631 and input setting from an operating portion 601. The RAM 650 is used as an area for temporarily holding control data and a work area for calculation associated with control.

The external interface 637 is an interface for a computer (PC) 620, and rasterizes print data into an image and outputs the image to the image signal control unit 634. The image output to the printer control unit 635 from the image signal control unit 634 is input to an exposure control unit.

The printer control unit 635 controls the image forming apparatus main body 1000, and the sheet processing apparatus control unit 636 controls the sheet processing apparatus 1500. In the present embodiment, a configuration in which the sheet processing apparatus control unit 636 is mounted on the sheet processing apparatus 1500 will be described.

However, the present invention is not limited to this. The sheet processing apparatus control unit 636 serving as control means may be provided in the image forming apparatus main body 1000 integrally with the CPU circuit unit 630, to directly control the sheet processing apparatus 1500 from the image forming apparatus main body 1000.

The sheet processing apparatus 1500 according to the present embodiment will be described below.

Figure 3:
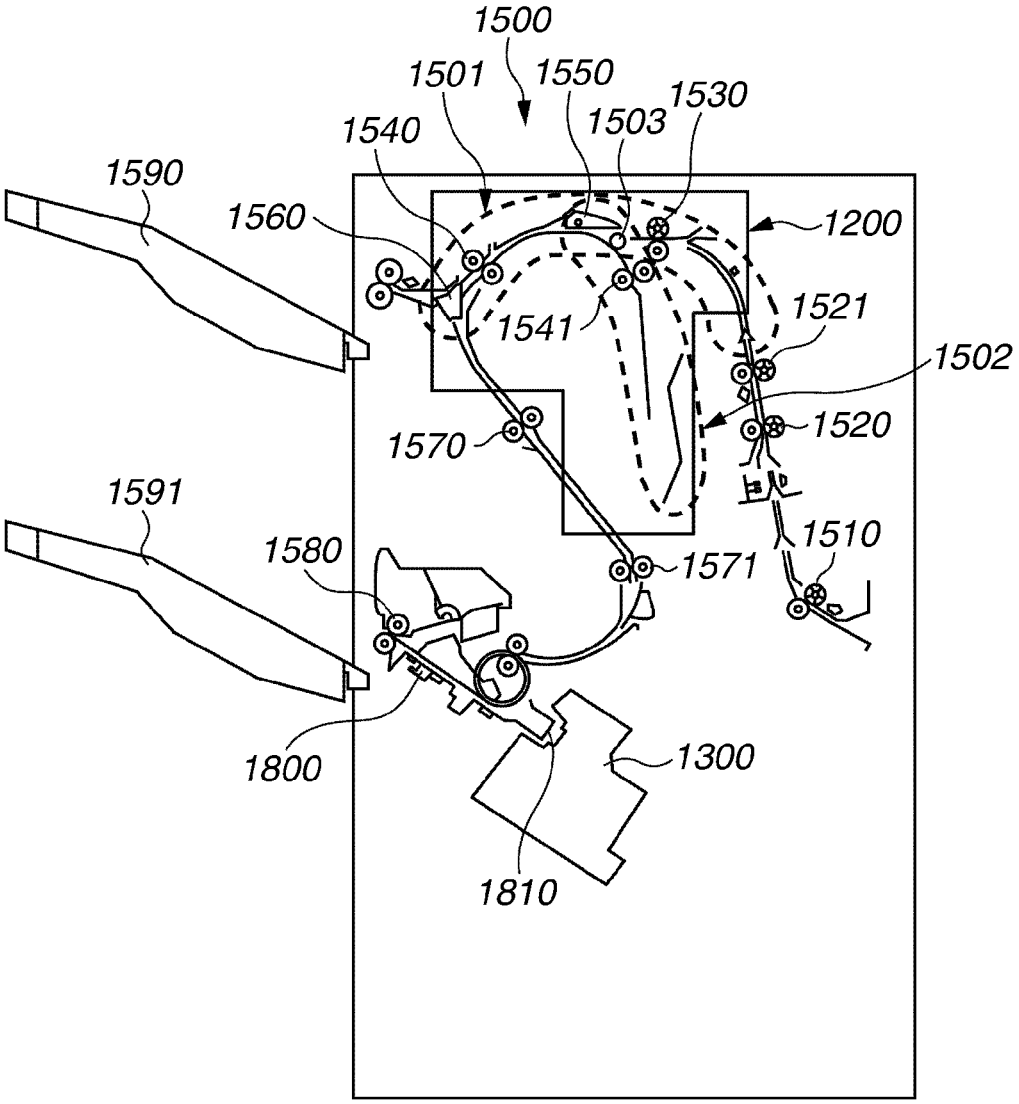
FIG. 3 is a cross-sectional view of a sheet processing apparatus according to an embodiment of the present invention.

In FIG. 1, the sheet discharged from the image forming apparatus main body 1000 is fed to the sheet processing apparatus 1500. In FIG. 3, the sheet processing apparatus 1500 sequentially accepts the sheet discharged from the image forming apparatus main body 1000, and performs various types of processing such as processing for aligning an accepted plurality of sheets to bind the sheets into one sheet bundle (alignment processing) and stapling processing for stapling trailing edges (upstream edges in a sheet conveyance direction) of the bound sheets with a stapler 1300.

The sheet processing apparatus 1500 includes an inlet roller 1510 for introducing the sheet discharged from the image forming apparatus main body 1000 into the sheet processing apparatus 1500, as illustrated in FIG. 3. There are conveyance rollers 1520 and 1521 downstream in the sheet conveyance direction of the inlet roller 1510. With this configuration, the sheet is conveyed to a conveyance path 1501.

In the conveyance path 1501, the sheet is fed from a conveyance roller 1530 toward a first buffer roller 1540 that is rotatable forward and backward. A second switching member 1560 arranged downstream in the sheet conveyance direction switches a conveyance direction of the sheet conveyed to the first buffer roller 1540.

More specifically, the conveyance direction is switched so that the sheet is stacked on a stacking tray 1590, or is directly stacked on a stacking tray 1591 by a discharge roller 1580 after being conveyed to first and second bundle conveyance rollers 1570 and 1571 or stacked on a processing tray 1800 for sheet processing.

The sheets stacked on the processing tray 1800 serving as sheet stacking means are subjected to alignment processing in a width direction by a jogger (not illustrated) and in a sheet conveyance direction by a stopper 1810, and stapling processing, and are then discharged as a sheet bundle onto the stacking tray 1591 by the discharge roller 1580. The stapler 1300 serving as processing means is used for the stapling processing. The stapler 1300 staples portions of the sheets, corresponding to a corner portion or a back portion of the sheet bundle.

Figure 4:
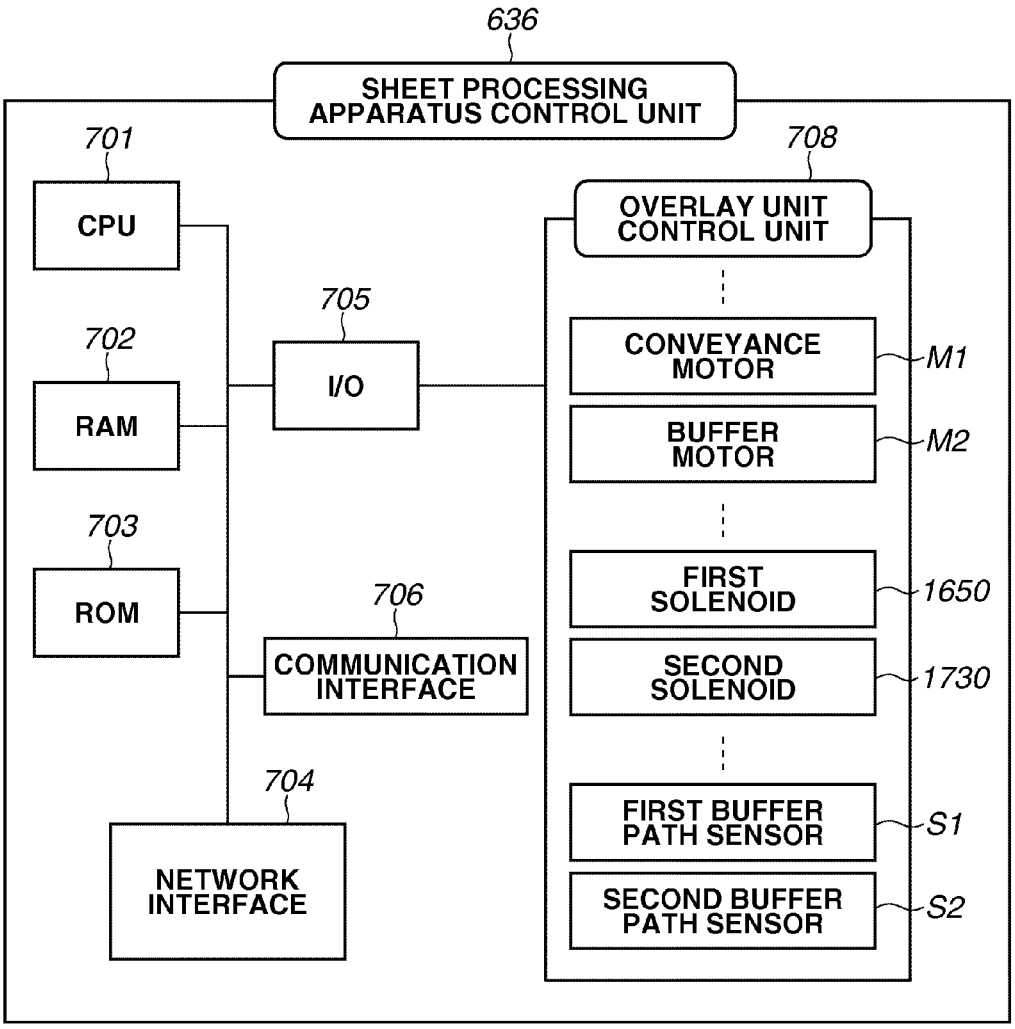
FIG. 4 is a block diagram of the sheet processing apparatus.

The sheet processing apparatus control unit 636 for controlling the sheet processing apparatus 1500 will be described below with reference to FIG. 4.

The sheet processing apparatus control unit 636 includes a CPU 701, a RAM 702, a ROM 703, an input/output (I/O) 705, a network interface 704, a communication interface 706.

The I/O 705 controls an overlap portion control unit 708. The overlap portion control unit 708 includes a conveyance motor M1, a buffer motor M2, a first solenoid 1650, and a second solenoid 1730, a first buffer path sensor S1, and a second buffer path sensor S2. The sheet processing apparatus control unit 636 controls motors M1 and M2, a first solenoid 1650, a second solenoid 1730 based on respective detection results of the sensors S1 and S2. Data communication is performed between the CPU circuit unit 630 on the side of the image forming apparatus main body 1000 and the CPU 701.

At this time, sheet information for each of the cassettes 1010*a* to 1010*d* input by the operating portion 601 on the side of the image forming apparatus main body 1000 is fed back to the sheet processing apparatus control unit 636, to determine whether the sheet is a tab sheet having a tab.

Figure 5A:
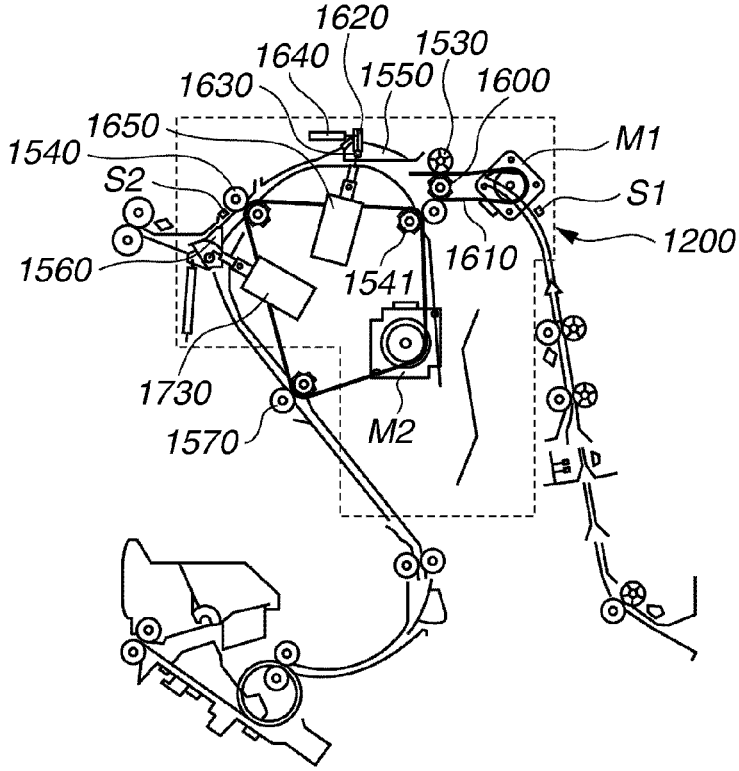
FIGS. 5A and 5B are cross-sectional views of a sheet overlap portion according to an embodiment of the present invention.

Details of a sheet overlap portion 1200 serving as overlap means will be described below with reference to FIGS. 5A and 5B.

In order to prevent productivity from deteriorating by stopping sheet conveyance from the image forming apparatus main body 1000 while the stapling processing is performed, the sheet overlap portion 1200 performs overlap processing of a predetermined number N of sheets conveyed during the stapling processing. More specifically, a sheet first conveyed is reversed in the conveyance path 1501 (FIG. 3), is branched in a branching portion 1503, and is made to temporarily wait in a conveyance path 1502.

The waiting sheet is joined with a sheet conveyed next, and the sheets are shifted and overlapped so that a downstream edge in the sheet conveyance direction of the sheet conveyed next precedes the waiting sheet by a predetermined amount, and the overlapped sheets are conveyed.

The first buffer path sensor S1 serving as first detection means is provided upstream of the conveyance roller 1530 in the sheet overlap portion 1200, and monitors whether a sheet enters the sheet overlap portion 1200.

The conveyance motor M1 transmits driving power to the conveyance roller 1530 via a conveyance roller pulley 1600 and a first timing belt 1610. A first switching member 1550 serving as a switching member is arranged downstream of the conveyance roller 1530, a first link shaft 1630 is attached to the first switching member 1550, and a first solenoid 1650 serving as driving means is connected to the first link shaft 1630 via a first link 1620.

When the first solenoid 1650 is turned on, the first link 1620 is pulled downward. Thus, the first switching member 1550 moves from a position illustrated in FIG. 5A to a position illustrated in FIG. 5B (in a direction indicated by an arrow Z). One end of a first link spring 1640 is attached to a link on the opposite side of the first link 1620, and the other end thereof is attached to a side plate (not illustrated). The first link spring 1640 serves as a stopper at the time of switching of the first switching member 1550 in a state of a natural length.

A first buffer roller 1540 is arranged downstream of the first switching member 1550. The first buffer roller 1540 is rotatable forward and backward to reverse a sheet. A direction of rotation is changed depending on whether the sheet is conveyed to a first bundle conveyance roller 1570 or is reversed and conveyed to a second buffer roller 1541.

Figure 5B:
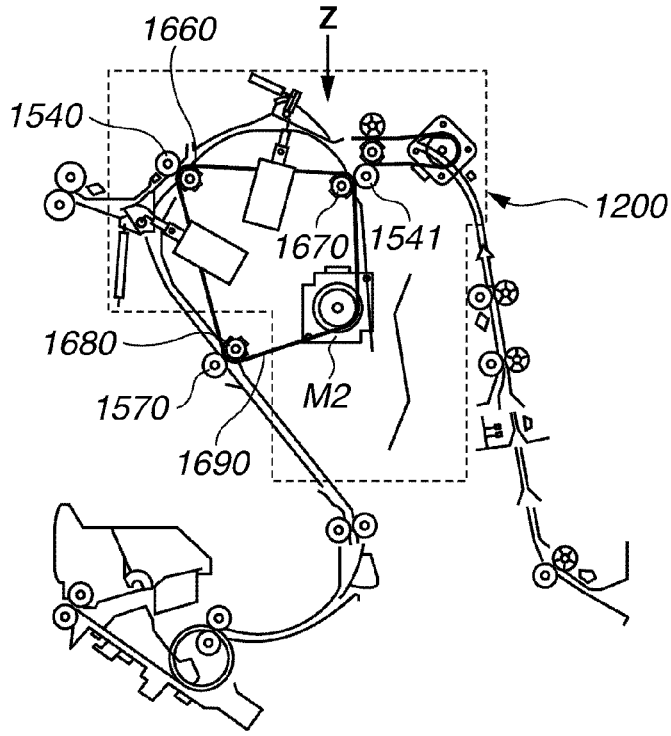

When the first buffer roller 1540 rotates backward to reverse the sheet, the first switching member 1550 is switched in the direction indicated by the arrow Z illustrated in FIG. 5B. Thus, the sheet is conveyed to the second buffer roller 1541, is temporarily made to wait, and is joined with a sheet to be conveyed next. The second buffer path sensor S2 serving as second detection means is arranged downstream of the first buffer roller 1540. Timing for reversing a sheet is determined according to ON/OFF of the second buffer path sensor S2.

Such a reversing operation is performed a predetermined number of times repeatedly, to form a sheet bundle. The sheet bundle is conveyed to the first bundle conveyance roller 1570. As illustrated in FIG. 5B, a first buffer roller pulley 1660, a second buffer roller pulley 1670, and a first bundle conveyance roller pulley 1680 are respectively attached to the first buffer roller 1540, the second buffer roller 1541, and the first bundle conveyance roller 1570.

Driving power of the buffer motor M2 serving as driving means is transmitted via a second timing belt 1690. Thus, the conveyance directions of the three rollers are switchable while they are synchronized with one another.

The flow of sheets occurring when the sheet overlap portion 1200 overlaps Nth sheets (N=3) will be described below with reference to FIGS. 6A to 6F.

Figure 6A:
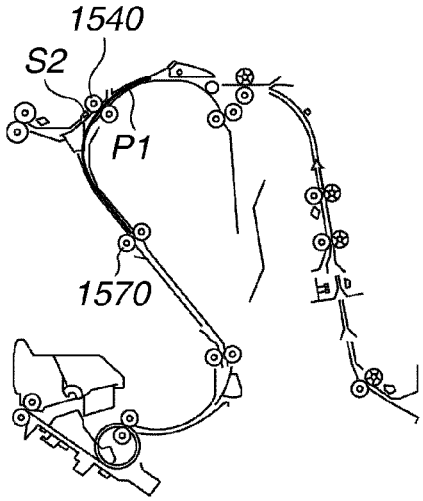
FIGS. 6A to 6F are cross-sectional views illustrating the flow of sheets occurring when the sheet overlap portion overlaps sheets.

A first sheet P1 is conveyed to the sheet overlap portion 1200, and passes through the first buffer roller 1540, as illustrated in FIG. 6A. The second buffer path sensor S2 is turned on when detecting a downstream edge (leading edge) in the sheet conveyance direction of the sheet P1. Then, the first buffer roller 1540 and the first bundle conveyance roller 1570 are stopped when the sheet P1 is conveyed by a predetermined amount.

Figure 6B:
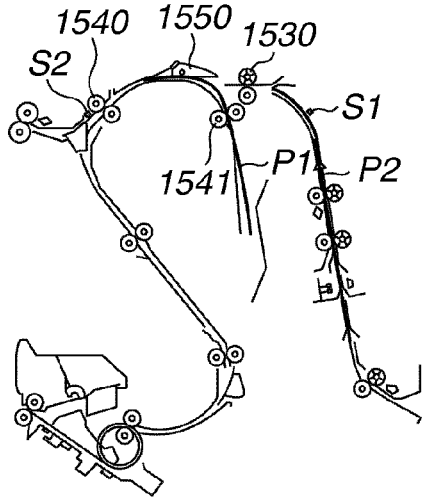

As illustrated in FIG. 6B, the first switching member 1550 moves downward, and the first buffer roller 1540 and the first bundle conveyance roller 1570 rotates backward after a predetermined period of time elapsed since the first buffer roller 1540 and the first bundle conveyance roller 1570 were stopped, to start to reverse the sheet P1. The reversed sheet P1 is conveyed to the second buffer roller 1541. Then, the second buffer roller 1541 is stopped when the sheet P1 is conveyed by a predetermined amount after the second buffer path sensor S2 is turned off. Thus, the sheet P1 temporarily waits while being pinched in the second buffer rollers 1541.

Figure 6C:
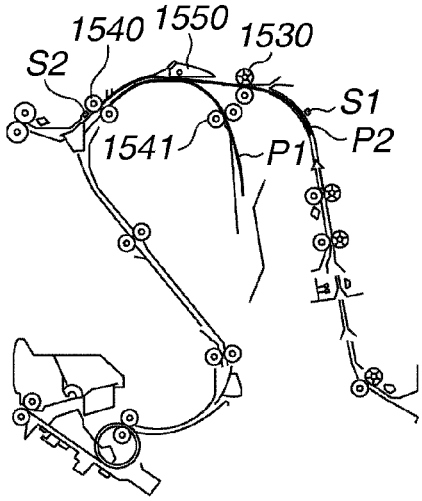

At the same time, a next sheet P2 is conveyed to the sheet overlap portion 1200. When the second buffer roller 1541 finishes rotating backward to convey the sheet P1, the first switching member 1550 moves upward, as illustrated in FIG. 6C. Thus, the sheet P2 is conveyed downstream in the sheet conveyance direction. The second buffer rollers 1541, which have pinched the sheet P1, starts to rotate forward after a predetermined period of time elapsed since the first buffer path sensor S1 detected a downstream edge in the sheet conveyance direction of the sheet P2. Thus, the sheet P1 and the sheet P2 are joined with each other.

At this time, timing for starting the buffer motor M2 (see FIG. 5) serving as driving means in the second buffer roller 1541 is set so that a trailing edge of the upper sheet P2 that is overlapped on the sheet P1 is positioned downstream in the sheet conveyance direction of the trailing edge of the sheet P1 by a predetermined amount. This enables an upstream edge (trailing edge) in the sheet conveyance direction of the lower sheet P1 to reliably abut on the stopper 1810 by switchback after the sheet P1 is conveyed to the processing tray 1800, thereby preventing alignment failure.

Figure 6D:
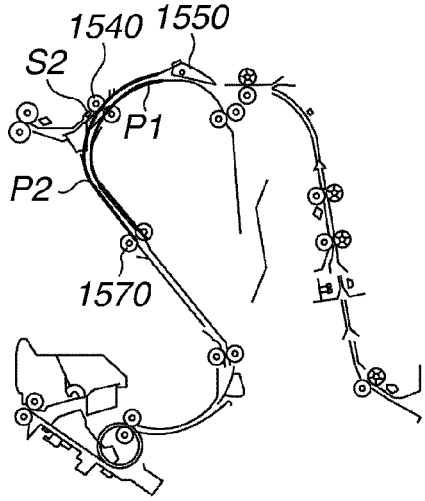
Figure 6E:
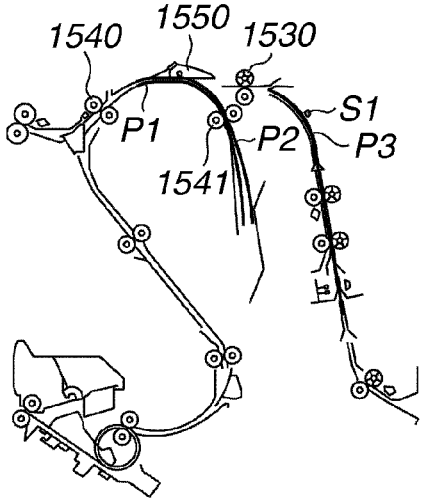
Figure 6F:
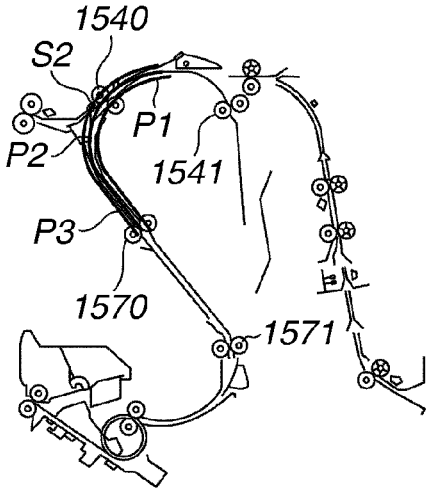

The overlapped sheets P1 and P2 pass through the first buffer roller 1540 and the second buffer path sensor S2. The second buffer path sensor S2 is turned on when detecting leading edges of the sheets P1 and P2. Then, the first buffer roller 1540 and the first bundle conveyance roller 1570 are stopped, as illustrated in FIG. 6D, when the sheets P1 and P2 are conveyed by a predetermined distance. The first switching member 1550 moves downward again.

The first buffer roller 1540 and the first bundle conveyance roller 1570 rotate backward. Thus, the sheets P1 and P2 are reversed, and are conveyed to the second buffer roller 1541. The second buffer roller 1541 is stopped when the sheets P1 and P2 are conveyed by a predetermined amount after the second buffer path sensor S2 is turned off. Thus, the sheets P1 and P2 wait while being pinched in the second buffer rollers 1541. The first switching member 1550 moves upward.

Further, a next sheet P3 is conveyed. The second buffer rollers 1541 that pinch the sheets P1 and P2 starts to rotate forward after a predetermined period of time elapsed since the first buffer path sensor S1 is turned on. Thus, the sheet P3 is overlapped on the sheets P1 and P2. At this time, timing for starting the buffer motor M2 is also set so that a trailing edge of the upper sheet P3 is positioned downstream in the sheet conveyance direction of the trailing edge of the lower sheet P2 by a predetermined amount. The overlapped sheets P1 to P3 are conveyed to the first buffer roller 1540 while being shifted by a predetermined amount in the sheet conveyance direction, and are further conveyed downstream by the first and second bundle conveyance rollers 1570 and 1571 serving as conveyance means.

A predetermined amount of shift between the sheets is set so that a positional relationship in the sheet conveyance direction between the sheets is not reversed even when an error occurs, and is implemented by detecting edges in the sheet conveyance direction of the sheets to control timing for stopping and conveying the overlapped sheets. The timing for stopping and conveying the overlapped sheets is required to be determined in a short time to realize increase in speed of sheet conveyance, and is controlled based on detection of downstream edges (leading edges) in the sheet conveyance direction of the sheets.

An operation performed when a tab sheet is overlaid, which features the present invention, will be described below with reference to FIG. 7.

When the tab sheet is overlaid, control is performed so that a sheet overlap operation ends at a time point where the tab sheet is overlaid. The tab sheet is made of thick paper having a larger thickness than that of a normal sheet having no tab, and thus has a larger weight than that of the normal sheet. When the tab sheet is overlaid on a position other than the uppermost sheet, the tab sheet may be unable to transport because the weight thereof is large even if it attempts to abut on the stopper 1810 by a transporting force generated by friction with the upper sheet.

A tab that projects downstream in the conveyance direction by a predetermined width may be more greatly curled than another sheet portion that does not project due to the effect of a thermal capacitance when it passes through a fixing device for fixing a toner image onto the tab sheet. This tendency is significant when the tab sheet is made of thick paper, as described above. When the tab sheet is overlaid on a position other than the uppermost sheet with the tab curled upward, the above-mentioned control is performed to prevent the curled tab from being unable to transport by acting as a resistance to a transporting operation of the normal sheet overlaid thereon.

Figure 7A:
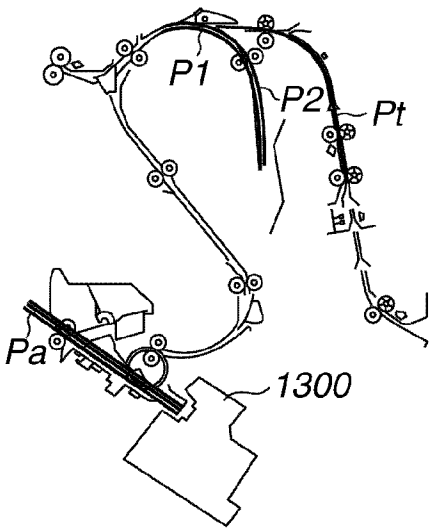
FIGS. 7A to 7F are cross-sectional views illustrating a case where the sheet overlap portion overlaps a tab sheet.
Figure 7B:
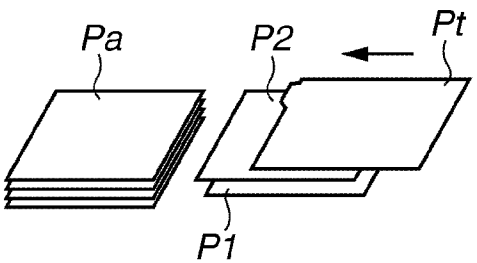
Figure 7C:
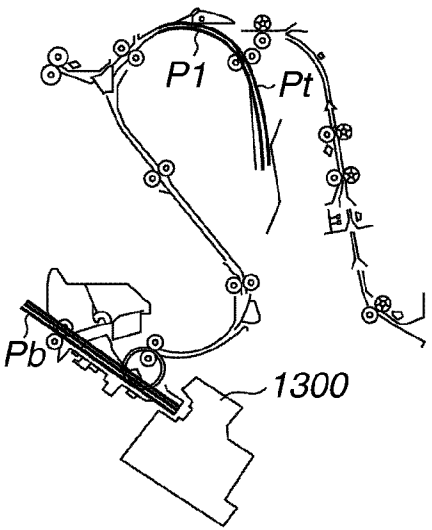
Figure 7D:
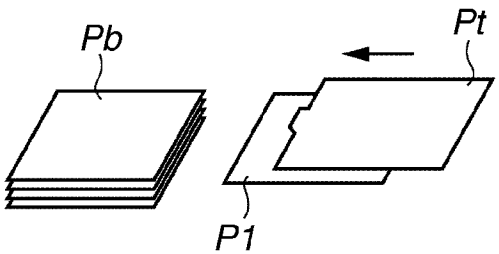
Figure 7E:
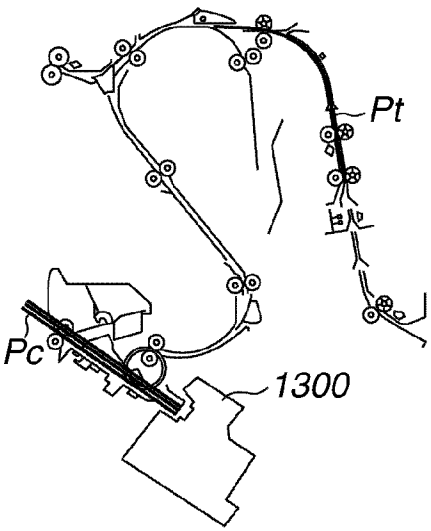
Figure 7F:
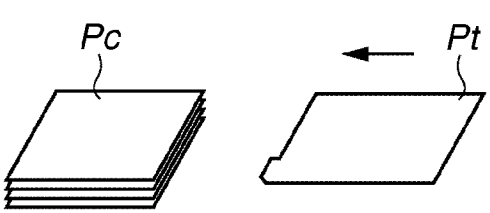

FIGS. 7A and 7B illustrate a case where the third one of sheets which are conveyed while a preceding sheet bundle Pa is processed to wait in a conveyance path, is a tab sheet. FIGS. 7C and 7D illustrate a case where the second one of the waiting sheets is a tab sheet. FIGS. 7E and 7F illustrate a case where the first one of the waiting sheets is a tab sheet. FIGS. 7A, 7C, and 7E are cross-sectional views, and FIGS. 7B, 7D, and 7F are perspective views illustrating a positional relationship between sheets.

As illustrated in FIGS. 7A and 7B, the sheets P1 and P2, which are normal sheets, wait in an overlapped state while the stapler 1300 processes the preceding sheet bundle Pa, and a sheet Pt, which is a tab sheet, is conveyed and is overlaid on the sheets P1 and P2.

Figure 8A:
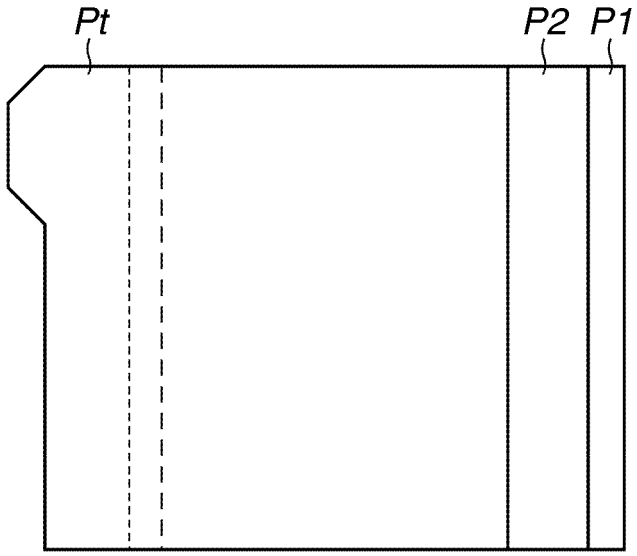
FIGS. 8A and 8B illustrate the result of overlap processing in the sheet overlap portion.
Figure 8B:
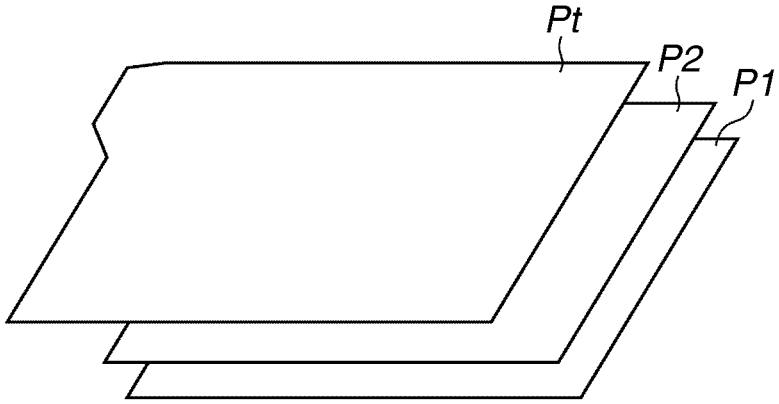

FIGS. 8A and 8B illustrate a state where the tab sheet Pt is overlaid on the sheets P1 and P2. The sheets P1 and P2 and the tab sheet Pt are overlapped so that an amount of shift between the sheet P2 and the tab sheet Pt is larger than an amount of shift between the sheets P1 and P2. The reason for this will be described below. The three sheets are conveyed downstream in the sheet conveyance direction while being thus overlapped.

When the second waiting sheet is the tab sheet Pt, as illustrated in FIGS. 7C and 7D, the tab sheet Pt is overlaid on the waiting sheet P1, and the two sheets wait in an overlapped state until the processing of the preceding sheet bundle Pb ends. When the processing of the sheet bundle Pb ends, the two sheets are conveyed downstream in the sheet conveyance direction while being overlapped without another sheet being further overlaid on the tab sheet Pt.

A period of time during which the two sheets wait while the tab sheet Pt is overlaid on the sheet P1 is similar to that when the number of waiting sheets is three, as illustrated in FIGS. 7A and 7B. In the present embodiment, a period of time during which the stapler 1300 processes the preceding sheet bundle Pa is set as being similar to a period of time during which the first three of the succeeding sheets are overlapped.

As described above, sheet information input by the operating portion 601 serving as an input portion is communicated between the CPU circuit unit 630 on the side of the image forming apparatus main body 1000 and the CPU 701 on the side of the sheet processing apparatus control unit 636. If it is determined that the succeeding sheet is a tab sheet having a tab, a signal for temporarily stopping sheet conveyance is sent to the CPU circuit unit 630, to space the sheets fed from each of the cassette 1010*a* to 1010*d* apart by a distance corresponding to one sheet.

If the first waiting sheet is the tab sheet Pt, as illustrated in FIGS. 7E and 7F, the tab sheet Pt waits until the stapler 1300 finishes processing the preceding sheet bundle Pc.

When the processing of the preceding sheet bundle Pc ends, the tab sheet Pt alone is conveyed downstream in the sheet conveyance direction without another sheet being further overlaid on the tab sheet Pt. When the tab sheet Pt alone waits, as described above, sheet conveyance from the image forming apparatus main body 1000 is temporarily stopped, to space the sheets from each of the cassettes 1010*a* to 1010*d* apart by a distance corresponding to two sheets.

Control is performed so that the tab sheet Pt is thus always at the uppermost position without another sheet being overlaid on the tab sheet Pt based on sheet information relating to a sheet fed for overlap processing to the sheet overlap portion 1200.

The CPU circuit unit 630 on the side of the image forming apparatus main body 1000 and the CPU 701 on the side of the sheet processing apparatus 1500 communicate with each other, to determine how many sheets are conveyed before the tab sheet Pt. More specifically, it is determined whether the succeeding sheet (M+1th) is to be overlaid on a sheet (Mth) fed to the sheet overlap portion for overlap based on sheet information relating to the Mth sheet fed for overlap before a number of the fed sheets reaches the predetermined number N of the sheets capable of being overlapped.

Therefore, the sheet processing apparatus 1500 can determine the number of sheets to be overlaid, and finishes performing an overlap operation at a time point where the tab sheet Pt is overlaid at the uppermost position. Thus, the tab sheet Pt can always be at the uppermost position.

In order to enable an upstream edge (trailing edge) in the sheet conveyance direction of the lower sheet P1 to reliably abut on the stopper 1810 by switchback after the tab sheet Pt is conveyed to the processing tray 1800 when overlaid on the lower sheet P1, as described above, the sheets are required to be shifted in the sheet conveyance direction. However, the tab sheet Pt having a tab that project at a position, which differs depending on the individual tab sheet, in a width direction perpendicular to the sheet conveyance direction is conveyed with the tab at its leading edge. Therefore, timing for overlay differs depending on whether the tab is detected.

In order to realize this, a sensor for sensing an edge in the sheet conveyance direction of a sheet can be provided at each of positions where a plurality of tabs is detected. However, in the present embodiment, a single sensor realizes this by adding, based on sheet information indicating that a sheet to be conveyed next is a tab sheet Pt, a length in the sheet conveyance direction of a tab to an amount of shift of the tab sheet Pt.

As illustrated in FIGS. 8A and 8B, a positional relationship in the sheet conveyance direction between the normal sheet and the tab sheet Pt overlaid thereon is prevented from being reversed by increasing the amount of shift of the tab sheet Pt by the length in the sheet conveyance direction of the tab.

Figure 9:
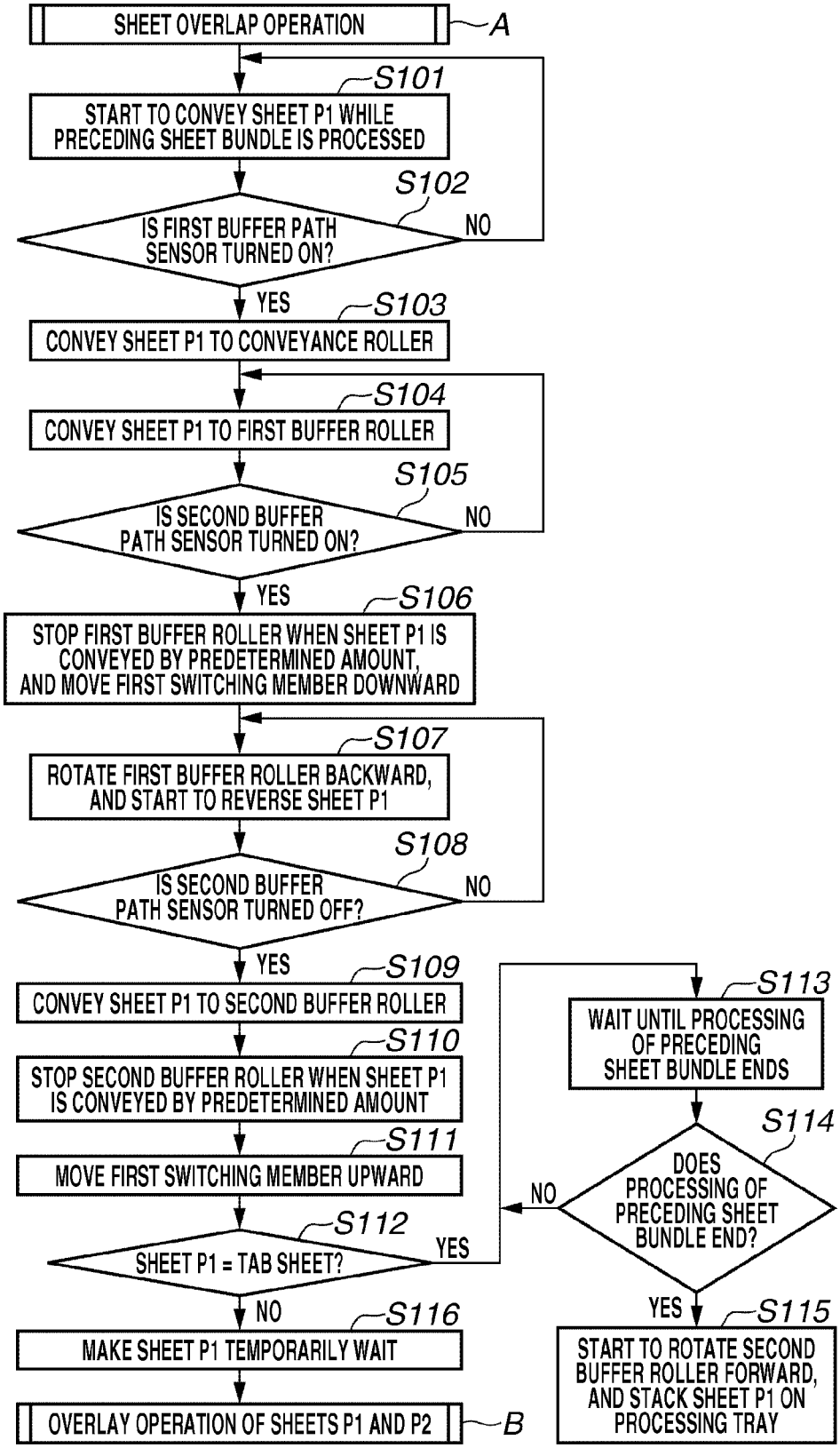
FIG. 9 is a flowchart illustrating an overlap operation in the sheet overlap portion.

A sheet overlay operation A of the sheet overlap portion 1200 serving as overlay means according to the present embodiment will be described below with reference to FIG. 9.

In steps S101, the sheet processing apparatus control unit 636 starts to convey a sheet P1 while the preceding sheet bundle is processed. In step S102, the sheet processing apparatus control unit 636 determines whether the first buffer path sensor S1 is turned on after the sheet P1 passes therethrough. If the first buffer path sensor S1 is turned on (YES in step S102), the processing proceeds to step S103. In step S103, the sheet processing apparatus control unit 636 conveys the sheet P1 to the conveyance roller 1530. In step S104, the sheet processing apparatus control unit 636 conveys the sheet P1 to the first buffer roller 1540.

In step S105, the sheet processing apparatus control unit 636 determines whether the second buffer path sensor S2 is turned on as the sheet P1 passes therethrough. If the second buffer path sensor S2 is turned on (YES in step S105), the processing proceeds to step S106. In step S106, the sheet processing apparatus control unit 636 stops the first buffer roller 1540 when the sheet P1 is conveyed by a predetermined amount, so that the conveyance of the sheet P1 is stopped, and moves the first switching member 1550 downward so that the sheet P1 can be conveyed to a waiting position. In step S107, the sheet processing apparatus control unit 636 rotates the first buffer roller 1540 backward, and starts to reverse the sheet P1. In step S108, the sheet processing apparatus control unit 636 determines whether the second buffer path sensor S2 is turned off after a leading edge of the sheet P1 exits the second buffer path sensor S2. If the second buffer path sensor S2 is turned off (YES in step S108), the processing proceeds to step S109. In step S109, the sheet processing apparatus control unit 636 conveys the sheet P1 to the second buffer roller 1541.

In step S110, the sheet processing apparatus control unit 636 then stops the second buffer roller 1541 when the sheet P1 is conveyed by a predetermined amount after its leading edge exits the first buffer roller 1540 and exits the second buffer path sensor S2. In step S111, the sheet processing apparatus control unit 636 moves the first switching member 1550 upward. At this time, the sheet P is stopped so that its leading edge is positioned downstream of the first switching member 1550.

In step S112, the sheet processing apparatus control unit 636 determines whether the sheet P1 is a tab sheet. If the sheet P1 is a tab sheet (YES in step S112), the processing proceeds to step S113. In step S113, the sheet processing apparatus control unit 636 makes the sheet P1 wait at a stop position until the processing of the preceding sheet bundle ends. In step S114, the sheet processing apparatus control unit 636 determines whether the processing of the preceding sheet bundle ends. If the processing of the preceding sheet bundle ends (YES in step S114), the processing proceeds to step S115. In step S115, the sheet processing apparatus control unit 636 rotates the second buffer roller 1541 forward, conveys the sheet P1, and stacks the sheet P1 on the processing tray 1800. If the sheet P1 is not a tab sheet (NO in step S112), the processing proceeds to steps S116. In step S116, the sheet processing apparatus control unit 636 makes the sheet P1 temporarily wait at a position where the sheet P1 is reversed until a sheet P2 to be then conveyed is conveyed to a predetermined position. An overlay operation B of the waiting sheet P1 and the sheet P2 to be conveyed next is performed.

Figure 10:
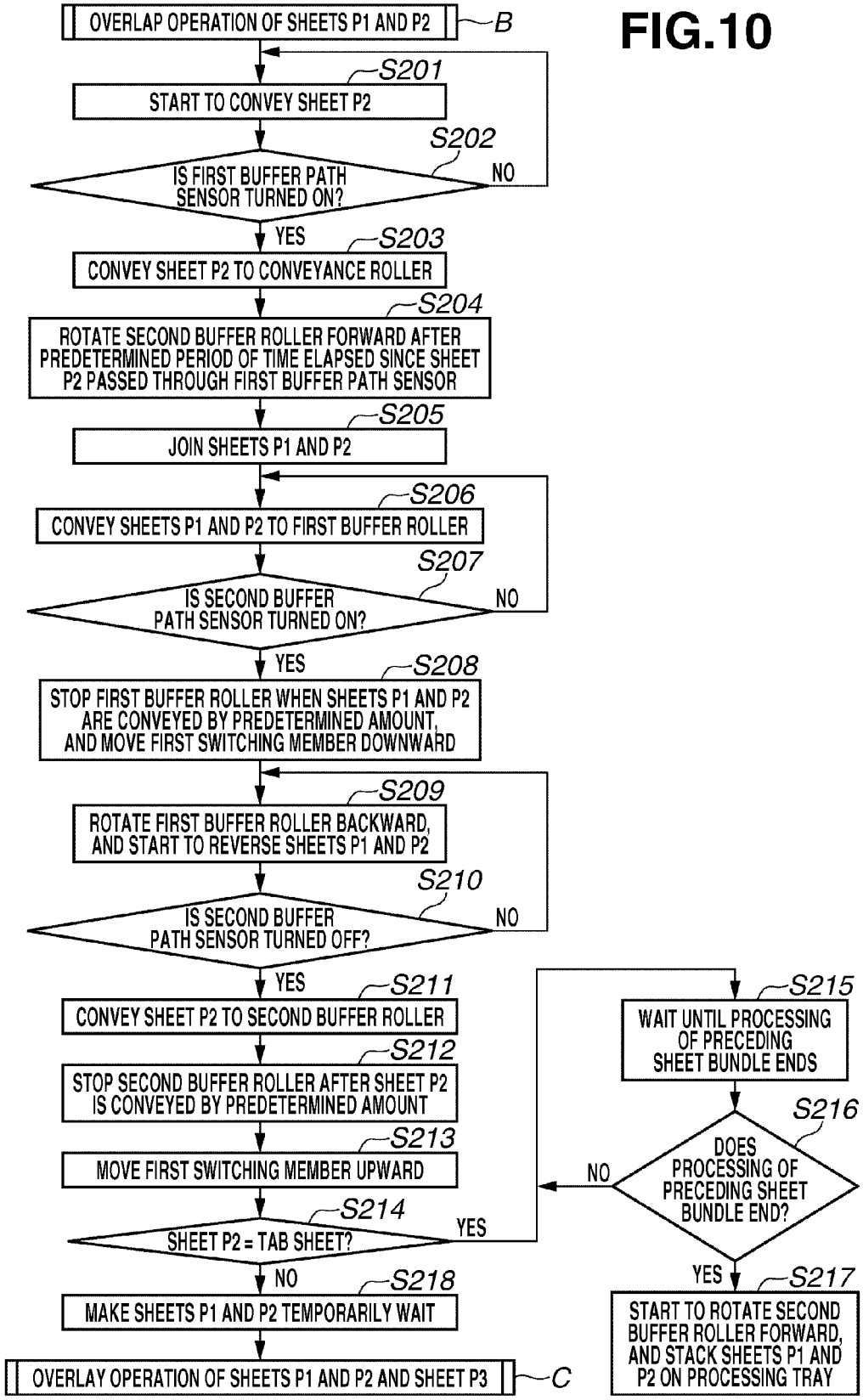
FIG. 10 is a flowchart illustrating an overlap operation performed when the first sheet is not a tab sheet according to an embodiment of the present invention.
Figure 11:
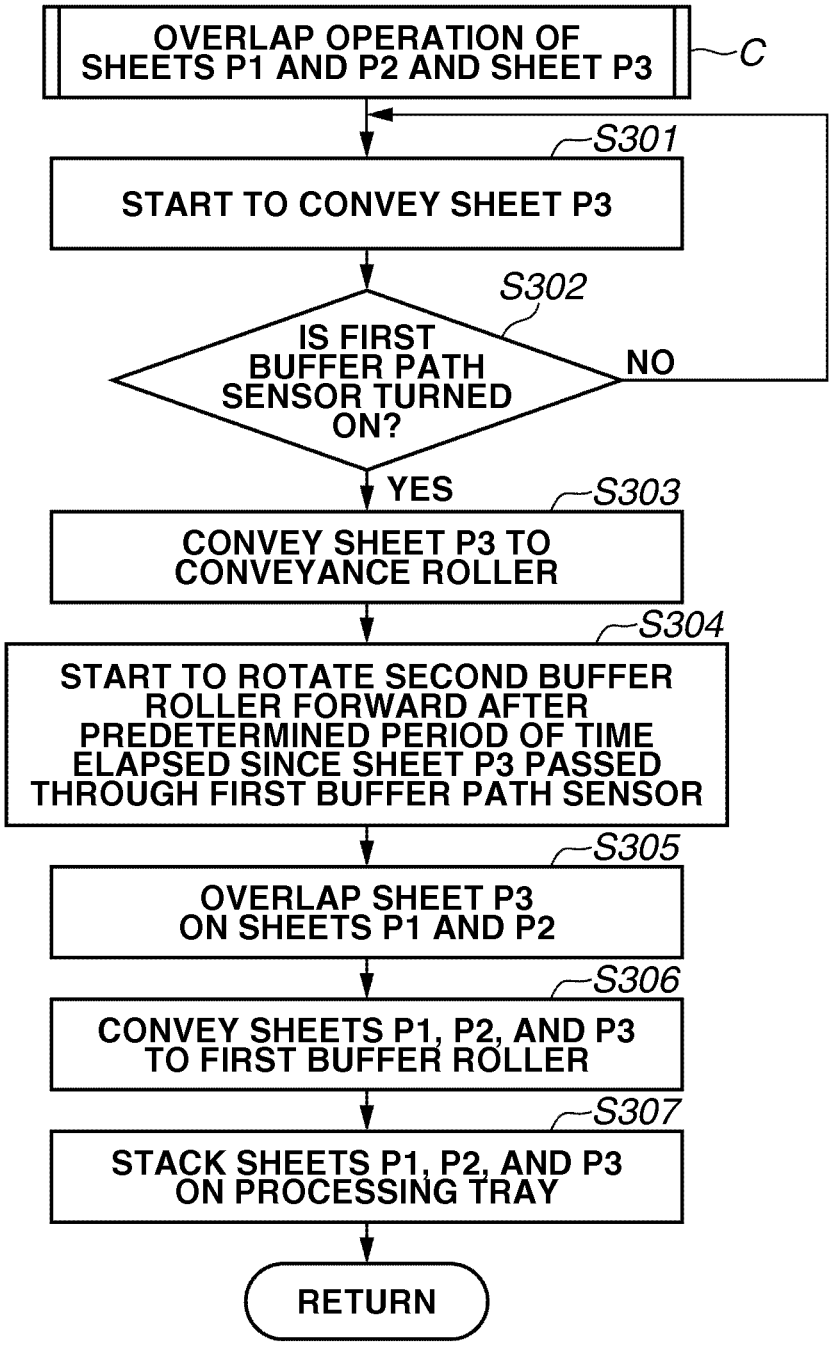
FIG. 11 is a flowchart illustrating an overlap operation performed when the second sheet is not a tab sheet according to an embodiment of the present invention.

The overlay operation B of the sheets P1 and P2 will be described below with reference to FIG. 10.

In step S201, the sheet processing apparatus control unit 636 starts to convey the sheet P2 to be conveyed next. In step S202, the sheet processing apparatus control unit 636 determines whether the first buffer path sensor S1 is turned on as the sheet P2 passes therethrough. If the first buffer path sensor S1 is turned on (YES in step S202), the processing proceeds to step S203. In step S203, the sheet processing apparatus control unit 636 conveys the sheet P2 to the conveyance roller 1530. In step S204, the sheet processing apparatus control unit 636 rotates the second buffer roller 1541 forward after a predetermined period of time elapsed since the sheet P2 has passed through the first buffer path sensor S1. In step S205, the sheet processing apparatus control unit 636 conveys the sheet P1, and joins the sheets P1 and P2 with each other at downstream of the first switching member 1550, and overlays the sheets P1 and P2.

In step S206, the sheet processing apparatus control unit 636 conveys the sheets P1 and P2 to the first buffer roller 1540. In step S207, the sheet processing apparatus control unit 636 determines whether the second buffer path sensor S2 is turned on as the sheets P1 and P2 pass therethrough. If the second buffer path sensor S2 is turned on (YES in step S207), the processing proceeds to step S208. In step S208, the sheet processing apparatus control unit 636 stops the first buffer roller 1540 when the sheets P1 and P2 are conveyed by a predetermined amount, and moves the first switching member 1550 downward.

In step S209, the sheet processing apparatus control unit 636 then rotates the first buffer roller 1540 backward, and starts to reverse and convey the sheets P1 and P2. In step S210, the sheet processing apparatus control unit 636 determines whether the second buffer path sensor S2 is turned off as a leading edge of the sheet P2 exits the second buffer path sensor S2. If the second buffer path sensor S2 is turned off (YES in step S210), the processing proceeds to step S211. In step S211, the sheet processing apparatus control unit 636 then conveys the sheet P2 to the second buffer roller 1541. In step S212, the sheet processing apparatus control unit 636 stops rotating the second buffer roller 1541 backward when the sheet P2 is conveyed by a predetermined amount after its leading edge exits the second buffer path sensor S2. In step S213, the sheet processing apparatus control unit 636 moves the first switching member 1550 upward.

In step S214, the sheet processing apparatus control unit 636 determines whether the sheet P2 is a tab sheet. If the sheet P2 is a tab sheet (YES in step S214), the processing proceeds to step S215. In step S215, the sheet processing apparatus control unit 636 makes the sheets P1 and P2 wait until the processing of the preceding sheet bundle ends. In step S216, the sheet processing apparatus control unit 636 determines whether the processing of the preceding sheet bundle ends. If the processing of the preceding sheet bundle ends (YES in step S216), the processing proceeds to step S217. In step S217, the sheet processing apparatus control unit 636 rotates the second buffer roller 1541 forward, starts to convey the sheets P1 and P2, and stacks the sheets P1 and P2 on the processing tray 1800. If the sheet P2 is not a tab sheet (NO in step S214), the processing proceeds to step S218. In step S218, the sheet processing apparatus control unit 636 makes the sheets P1 and P2 wait until the sheets P1 and P2 are conveyed to a position where they are reversed and a sheet P3 to be conveyed next is conveyed to a predetermined position.

If the sheet P2 is not a tab sheet, an overlay operation C of the sheets P1 and P2 and the sheet P3 is then performed. The overlay operation C of the sheets p1 and P2 and the sheet P3 will be described with reference to FIG. 11. In step S301, the sheet processing apparatus control unit 636 starts to convey the sheet P3 while the sheets P1 and P2 wait. In step S302, the sheet processing apparatus control unit 636 determines whether the first buffer path sensor S1 is turned on as the sheet P3 passes therethrough. If the first buffer path sensor S1 is turned on (YES in step S302), the processing proceeds to step S303. In step S303, the sheet processing apparatus control unit 636 conveys the sheet P3 to the conveyance roller 1530.

In step S304, the sheet processing apparatus control unit 636 rotates the second buffer roller 1541 forward after a predetermined period of time elapsed since a leading edge of the sheet P3 passes through the first buffer path sensor S1. In step S305, the sheet processing apparatus control unit 636 starts to convey the sheets P1 and P2, and overlays the sheet P3 on the sheets P1 and P2. In step S306, the sheet processing apparatus control unit 636 conveys the sheets P1 and P2 and the sheet P3 to the first buffer roller 1540. In step S307, the sheet processing apparatus control unit 636 directly stacks the sheets P1 and P2 and the sheet P3 on the processing tray 1800.

In the above-mentioned tab sheet, when the tab that projects downstream in the conveyance direction by a predetermined width passes through a fixing device for fixing a toner image onto a sheet, it may be more greatly curled than another sheet portion that does not project due to the effect of a thermal capacitance. This tendency is significant when the tab sheet is made of thick paper, as described above. If the tab sheet is the first one of three sheets, for example, with the tab curled upward, the curled tab may be unable to transport by acting as a resistance to a transporting operation of the second sheet.

Deterioration in alignment of a sheet to be overlaid and buffered due to the weight of the sheet may occur in not only a tab sheet but also coated paper having a high density and having a low frictional resistance on its surface or a Z-folded sheet obtained by folding a large-format sheet small and in a Z shape. Therefore, the present invention in which it is determined, based on sheet information relating to a sheet fed for overlay to the sheet overlap portion, whether the succeeding sheet is overlaid on the sheet fed for overlay is also effective for the coated paper and the Z-folded sheet.

While the present invention has been described with reference to embodiments, it is to be understood that the invention is not limited to the disclosed embodiments.

This application claims priority from Japanese Patent Application No. 2010-113844 filed May 18, 2010 and No. 2011-099697 filed Apr. 27, 2011, which are hereby incorporated by reference herein in their entirety.

What is claimed is:

1. A sheet processing apparatus comprising:

a sheet stacking unit configured to stack sheets to be processed;

a sheet overlap unit configured to allow a predetermined number N of successively fed sheets to be overlapped and made to wait, while a preceding sheet bundle to be processed is being stacked on the sheet stacking unit;

a conveyance unit configured to convey overlapped sheets from the sheet overlap unit to the sheet stacking unit; and a control unit configured to control the overlapping of sheets in the sheet overlap unit, wherein the control unit is arranged to determine, based on sheet information relating to an Mth sheet fed to the sheet overlap unit, before the number of fed sheets reaches the predetermined number N, whether an M+1th sheet is overlapped on the Mth sheet in the sheet overlap unit.

2. The sheet processing apparatus according to claim 1, wherein the sheet stacking unit includes a stopper on which an upstream edge in a conveyance direction of the sheet conveyed by the conveyance unit from the sheet overlap unit abuts in use, and wherein the control unit is arranged to perform control, when the sheet overlap unit overlaps the sheets, so that an upstream edge in the conveyance direction of the lower overlaid sheet is positioned upstream in the conveyance direction of an upstream edge in the conveyance direction of the upper overlaid sheet.

3. The sheet processing apparatus according to claim 1, wherein the control unit is arranged to perform control, based on sheet information indicating that the Mth sheet fed to the sheet overlap unit is a tab sheet having a projection that projects downstream in the conveyance direction provided at its downstream edge in the conveyance direction, so that the M+1th sheet to be fed next is not overlaid on the Mth sheet fed to the sheet overlap unit.

4. The sheet processing apparatus according to claim 1, wherein the control unit is arranged to perform control, based on sheet information indicating that the Mth sheet fed to the sheet overlap unit is coated paper, which has been subjected to processing for smoothing a surface, so that the M+1th sheet to be fed next is not overlaid on the Mth sheet fed to the sheet overlap unit.

5. The sheet processing apparatus according to claim 1, wherein the control unit is arranged to perform control, based on sheet information indicating that the Mth sheet fed to the sheet overlap unit is a Z-folded sheet, which has been folded in a Z shape, so that the M+1th sheet to be fed next is not overlaid on the Mth sheet fed to the sheet overlap unit.

6. An image forming apparatus comprising:

a feeding unit configured to feed a sheet on which an image is to be formed; and a sheet stacking unit configured to stack sheets to be processed;

a sheet overlap unit configured to allow a predetermined number N of successively fed sheets to be overlapped and made to wait, while a preceding sheet bundle to be processed is being stacked on the sheet stacking unit;

a conveyance unit configured to convey overlapped sheets from the sheet overlap unit to the sheet stacking unit; and a control unit configured to control the overlapping of sheets in the sheet overlap unit, wherein the control unit is arranged to determine, based on sheet information relating to an Mth sheet fed to the sheet overlap unit, before the number of fed sheets reaches the predetermined number N, whether an M+1th sheet is overlapped on the Mth sheet in the sheet overlap unit.

7. The image forming apparatus according to claim 6, further comprising:

an input unit configured to input sheet information relating to a sheet to be overlaid, wherein the control unit is arranged to temporarily stop, if it determines that the Mth sheet fed from the feeding unit is a tab sheet having a projection that projects downstream in a conveyance direction of the conveyance unit provided at its downstream edge in the conveyance direction, feeding the M+1th sheet to be fed next to the tab sheet from the feeding unit based on the sheet information input from the input unit.

8. The image forming apparatus according to claim 6, further comprising:

an input unit configured to input sheet information relating to a sheet to be overlaid, wherein the control unit is arranged to temporarily stop, if it determines that the Mth sheet fed from the feeding unit is coated paper, which has been subjected to processing for smoothing a surface, feeding the M+1th sheet to be fed next to the coated paper from the feeding unit based on the sheet information input from the input unit.

9. The image forming apparatus according to claim 6, further comprising:

an input unit configured to input sheet information relating to a sheet to be overlaid, wherein the control unit is arranged to temporarily stop, if it determines that the Mth sheet fed from the feeding unit is a Z-folded sheet, which has been folded in a Z shape, feeding the M+1th sheet to be fed next to the Z-folded sheet from the feeding unit based on the sheet information input from the input unit.

* * * * *